US005884542A

United States Patent [19]

Gentile et al.

[11] Patent Number: 5,884,542

[45] Date of Patent: Mar. 23, 1999

[54] METHOD AND APPARATUS FOR DIE JAM PROTECTION/ANTICIPATION AND CORRECTION

[75] Inventors: Joseph P. Gentile, Pittsburgh; Vaughn H. Martin, Gibsonia; Daniel G. Lukas, Pittsburgh, all of Pa.

[73] Assignee: Vamco International, Inc., Pittsburg, Pa.

[21] Appl. No.: 813,828

[22] Filed: Mar. 6, 1997

[51] Int. Cl.[6] ..... B26D 5/00

[52] U.S. Cl. ..... 83/13; 83/62; 83/64; 83/360; 192/127; 72/5

[58] Field of Search ..... 72/4, 5, 30.2, 31.07; 192/127, 125 A, 150; 271/258.01, 259, 902; 226/24, 45, 100, 43; 83/13, 62, 64, 72, 76.8, 361, 360, 74, 73, 65, 649

[56] References Cited

U.S. PATENT DOCUMENTS

| | | | |
|---|---|---|---|
| Re. 28,602 | 11/1975 | Clark | 226/25 |
| 2,138,126 | 11/1938 | Smith et al. | 205/14 |
| 2,143,357 | 1/1939 | Montgomery | 80/32 |
| 2,263,246 | 11/1941 | Morgan | 205/14 |
| 3,764,050 | 10/1973 | Clark | 226/25 |
| 4,125,182 | 11/1978 | Karlowicz | 192/125 |
| 4,267,914 | 5/1981 | Saar | 192/147 |
| 4,286,487 | 9/1981 | Rubel | 83/62 X |
| 4,508,251 | 4/1985 | Harada et al. | 226/25 |
| 4,532,500 | 7/1985 | Henk | 340/675 |
| 4,574,669 | 3/1986 | Vercillo et al. | 83/62 X |
| 4,619,407 | 10/1986 | Goldhammer | 241/30 |
| 4,667,551 | 5/1987 | Kuromaru et al. | 83/72 |
| 5,091,962 | 2/1992 | Malloy et al. | 382/8 |
| 5,203,669 | 4/1993 | Klossek et al. | 414/525.2 |
| 5,377,296 | 12/1994 | Greenway et al. | 388/816 |
| 5,452,632 | 9/1995 | Durr et al. | 83/13 |
| 5,678,138 | 10/1997 | Kobayashi et al. | 399/18 |

FOREIGN PATENT DOCUMENTS

| | | | |
|---|---|---|---|
| 2219970 | 12/1989 | United Kingdom | 83/13 |

*Primary Examiner*—Rinaldi I. Rada
*Assistant Examiner*—Boyer Ashley
*Attorney, Agent, or Firm*—Webb Ziesenheim Bruening Logsdon Orkin & Hanson, P.C.

[57] ABSTRACT

A method and apparatus for protecting a die from damage due to material jams in material stamping equipment wherein feed material is stamped in a die and then advanced through the die by action of press feed rolls powered by a press feed roll drive motor. The position error of the press feed rolls or the torque of the press feed roll drive motor is monitored during the advance of the feed material through the die. The monitored position error of the press feed rolls or the monitored torque of the press feed roll drive motor is then compared to the expected position error of the press feed rolls or the expected torque of the press feed roll motor, respectively. The feed material is moved backwards to a previous position from which the feed material advanced, typically the position at which the feed material was last stamped, if the monitored position error of the press feed rolls or the monitored torque of the press feed roll drive motor deviates by more than a tolerance value from the expected position error of the press feed rolls or the expected torque of the press feed roll motor, respectively. Operation of the material stamping equipment may stopped after the feed material is moved back if desired.

18 Claims, 6 Drawing Sheets

METHOD AND APPARATUS FOR DIE JAM PROTECTION/ANTICIPATION AND CORRECTION

BACKGROUND OF THE INVENTION

The invention relates generally to the field of die stamping and more particularly to a method and apparatus for protecting a die and punch assembly from damage due to material jams.

Material stamping equipment, containing die and punch assemblies, stamps, forms or cuts patterns or holes in material that is fed into the die. As shown in FIG. 1, the stamping, forming or cutting is usually accomplished by a punch assembly 2 being driven into contact with the feed material 3 that is fed into the die 1. The feed material in turn is driven up against the die by the punch assembly. Material 4 that is stamped or cut out of the feed material 3 is ejected through holes 1*a* in the die if the stamping process does not become jammed. New feed material 3 is then advanced into the die 1 and material that has been stamped is advanced out of the die by the action of the press feed roll drive motor 5 and the press feed rolls 6.

It should be noted that the material stamping equipment, including the punch assembly 2, die 1, and material support 7, the press feed roll drive motor 5 and press feed rolls 6, and the in-position sensor 8 are all known in the art and are described and depicted in FIGS. 1, 2, 3, 4*a*, and 4*b* herein only as they relate to the current invention.

Unfortunately, as shown in FIG. 1 and FIG. 3, the material 4 stamped, formed or cut out from the pattern or hole in the feed material 3 does not always detach properly from the feed material and eject out of the die 1. This non-detaching material 4 either prevents the new feed material from fully advancing into the die 1 or remains in an unwanted position in the die causing damage to the die or renders subsequent work pieces improperly stamped.

Traditionally, as depicted in FIG. 2, and disclosed in U.S. Pat. No. 5,091,962, a die protection sensor 8, also known as an "in-position" sensor, is placed close to the feed material after said feed material has advanced through the die 1 to detect incorrectly positioned material. The problem with this traditional method is that, due to the high rate of speed at which material stamping machines operate, if a piece of material 4 is not properly stamped, formed or cut out of the feed material such that the material 4 is lodged in an undesirable position within the die as shown in FIG. 1 or FIG. 3, the punch assembly 2 will have already struck the jammed feed material and the die, potentially causing damage to the die, before the in-position sensor 8 can detect the incorrectly stamped material and stop the stamping machinery.

Buckle detectors have also been utilized to detect buckles 9 or other misfeeds in an effort to protect dies. However, the way such detectors have been traditionally used does not provide a satisfactory solution to the problem of material jamming because it provides only for stopping the press and still does not avoid damage to the material, die and punch assembly.

Accordingly, a method to protect dies from material jams, prior to the die stamping a subsequent work piece and thereby becoming damaged, has been desired.

SUMMARY OF THE INVENTION

The present invention provides protection to dies from material jams by sensing the parameters of the device used to advance feed material into and through a die and from determining whether a material jam has occurred. The present invention in addition, or alternatively, provides for correction of incorrectly positioned material before the press can be stopped however sensed.

According to the first aspect of the present invention, a method of protecting a die from damage due to material jams in material stamping equipment comprising the steps of monitoring at least one parameter of the device used to advance feed material into the die and stopping operation of the material stamping equipment if the measured value of the parameter being measured deviates from the expected value of that parameter.

According to a second aspect of the invention, a method of protecting a die from damage due to material jams in material stamping equipment comprises moving the feed material back to its previous position from which it advanced and, if desired, stopping operation of the material stamping equipment.

According to a third aspect of the invention, an apparatus for protecting a die from damage due to material jams in material stamping includes means for monitoring at least one parameter of the device used to advance feed material into a die, means for comparing the monitored parameter to the expected value of that parameter, controlling means for directing the device to move the feed material back to its previous position from which it advanced and stopping the material stamping equipment if the monitored parameter deviates from the expected value of that parameter.

The device used to advance feed material into the die can include a motor. More specifically, the device can include a press feed roll drive motor. The parameters of a motor that can be monitored include, among others, the monitored or calculated position error, velocity, acceleration, torque and jerk of the motor. To illustrate, as shown in FIG. 2, FIG. 4*a* and FIG. 4*b*, when press feed rolls 6 powered by a motor 5 are utilized to advance feed material 3 into the die 1 or punch assembly 2, the press feed rolls 6 powered by a motor 5 are programmed to rotate at a certain speed or number of revolutions, or fraction thereof, over a certain period of time. The press feed roll motor 5 turns the press feed rolls 6 which in turn act upon the feed material 3 to advance it into and through the die 1.

If a jam or misfeed occurs in the die or punch assembly, the feed material will be prevented from advancing all the way into the die or punch assembly. The failure of the feed material to advance all the way into the die inhibits the press feed rolls from moving or turning the distance they normally would rotate if no jam or misfeed had occurred. The positions of the press feed rolls can be measured or monitored and compared to the positions of the press feed rolls that should have been measured if a jam or misfeed had not occurred. The position error is the difference between the position that the rolls should have been in had there been no jam or misfeed and the position that the rolls actually were in as measured or monitored. If the position error is different from zero or some negligible amount determined by use or experiment, a jam or misfeed potentially has occurred.

Due to the various parameters affecting the position of the press feed rolls, the position error will most likely not be zero every time. Rather it will be slightly negative, indicating the feed material has moved more than usual or slightly positive, indicating the feed material has not moved as much as expected. Test or production runs of the material stamping equipment can be done and an acceptable range of tolerance values for position error of the press feed rolls can be determined from runs where no jam or misfeed occurs. This empirically calculated position error range can then be used as the expected position error to be compared against the measured or monitored position error to determine if a misfeed or jam has occurred. Thus, if there is any position error, or some position error over a certain tolerance value, where the tolerance value is determined by test runs, or projected, a jam or misfeed can be considered to exist. Velocity, acceleration or jerk could be similarly used as the monitored parameter.

Alternatively, if a jam occurs and the press feed roll drive motor is inhibited from turning the press feed rolls, the actual torque of the press feed motor will deviate from the torque that is expected or normal for the press feed roll motor to exert in the absence of a jam or misfeed. As shown in FIG. 5, the torque will most likely raise to a higher level earlier in time than would be expected and outside empirically determined or projected tolerance values because the motor is exerting more force because the feed material is jammed.

The present invention monitors these parameter values of the press feed rolls and/or press feed drive motor and compares them to the expected parameter values if no jam or misfeed had occurred in the die. If the monitored parameter values deviate by more than the tolerance values from the expected parameter values, a jam or misfeed has likely occurred.

If a jam has occurred it may be desirable to stop the material stamping equipment, namely the action of the press and punch assembly striking the feed material and the die, as soon as possible to avoid damaging the die. The present invention provides a method to shut down the material stamping equipment as soon as the monitored parameters deviate from their expected values, thereby preventing the die from being damaged by a material jam. Even though the current invention attempts to stop the press and punch assembly before any more feed material is advanced, the press and punch assembly continues to operate for potentially a few more strikes against the material jammed in the die.

Whether the press and punch assembly are stopped or not, the present invention allows for reversing the operation of the press feed rolls to pull the misfed feed material back out from the die.

Pulling the feed material back to a corrected position, generally the original position in which the feed material was last stamped, is designed to reposition the feed material which has been misfed into the die.

Thus, any feed material that was not correctly stamped or formed, or feed material which buckled, would be returned to a position in which another strike of the punch assembly would hit the material and the die at the proper location such that damage to the die and punch assembly is avoided. This may involve stopping press operation or continuing with the feed material in a correct position. This aspect of the invention may be utilized with traditional misfeed and buckle detection methods, such as methods using in-position sensors and buckle detectors respectively, or with the monitoring method of the invention described above.

The present invention, together with other aspects and attendant advantages thereof, will best be understood upon consideration of the following detailed description taken in conjunction with the following drawings.

DESCRIPTION OF THE PREFERRED EMBODIMENTS

Figure 6:
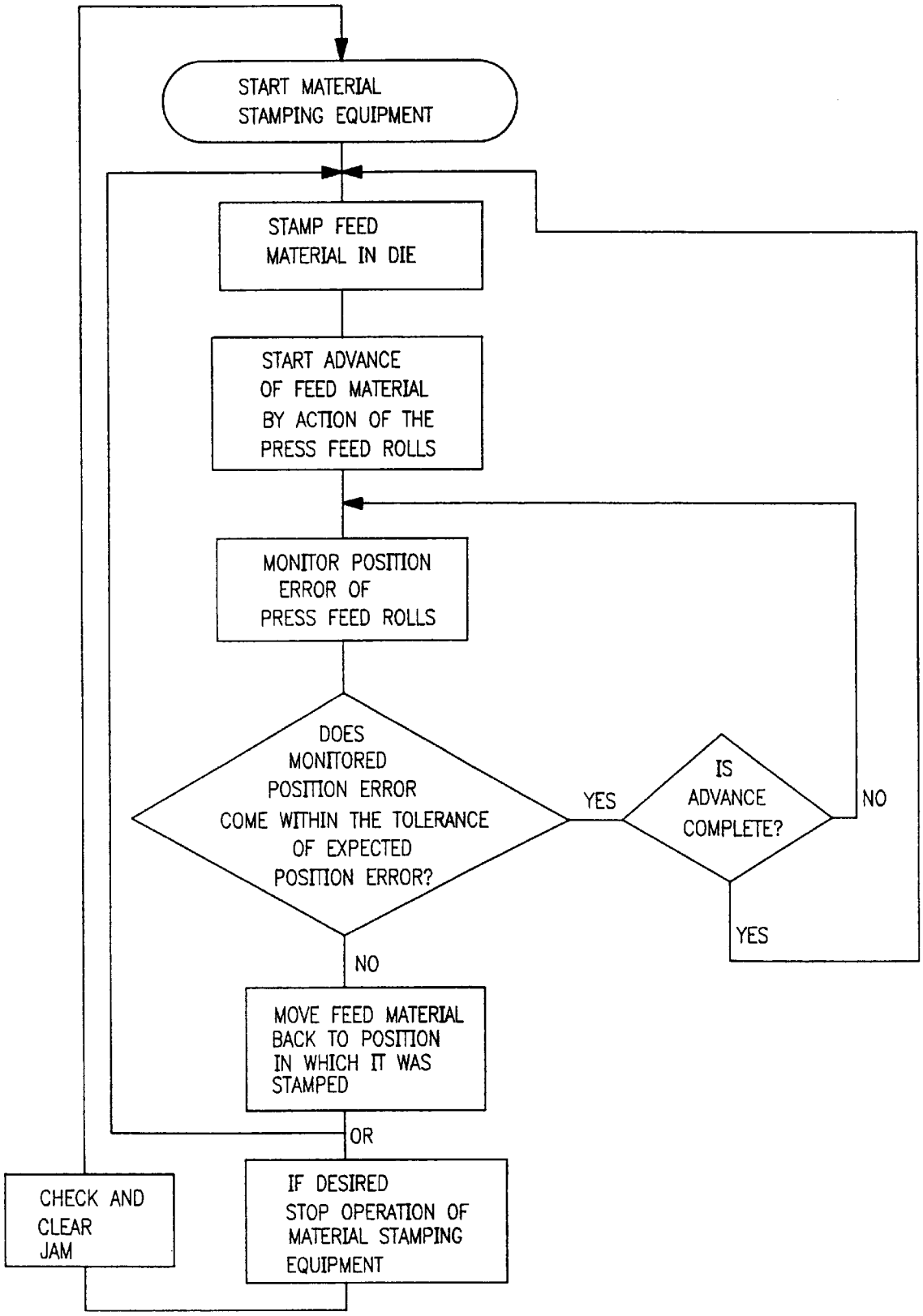
FIG. 6 is a flow chart of the preferred embodiment of the method to protect a die from jams by monitoring the position error of the press feed roll drive motor.
Figure 7:
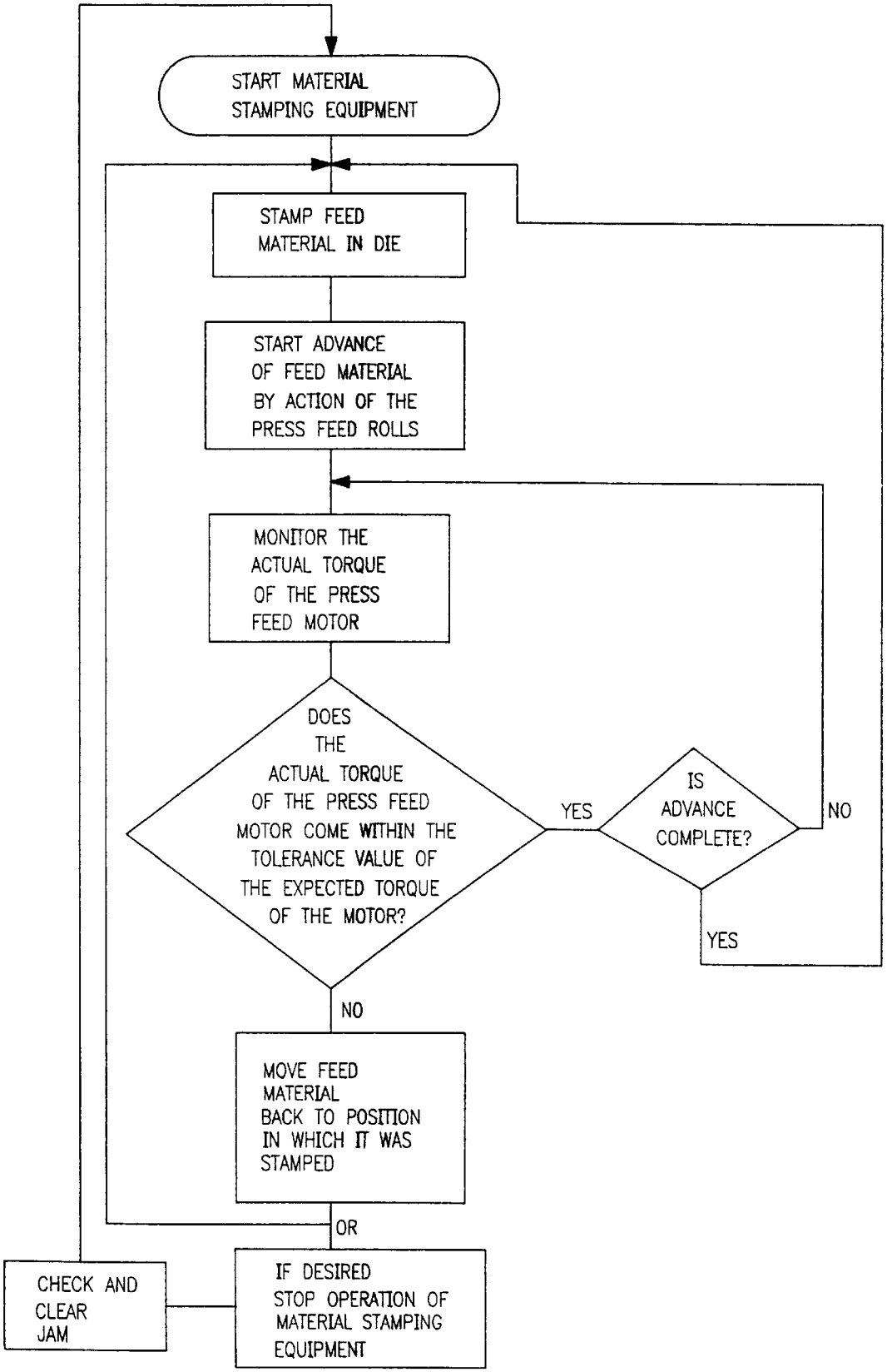
FIG. 7 is a flow chart of the preferred embodiment of the method to protect from die jams by monitoring the torque of the press feed roll drive motor.

The preferred embodiments of the steps of the present inventor are shown generally in FIGS. 6 and 7. The error detection and correction method may be employed by monitoring the position error of the press feed rolls, the torque of the press feed roll drive motor, or both.

The present invention may be implemented using a variety of control mechanisms either electronic, digital or analog, or mechanical because the method of operation of this invention is the same irrespective of the hardware that it is utilized.

A first preferred method of operation is depicted in FIG. 6 and consists of monitoring the positions of the press feed rolls and continuously comparing the monitored positions to the expected positions of the press feed rolls. The position error is calculated by comparing the expected positions of the press feed rolls to the monitored positions of the press feed rolls. A tolerance within which the position error of the press feed roll drive motor should stay if no jam or misfeed occurs can be determined empirically by compiling data on operation of the material stamping equipment during times when no jams or misfeeds occur.

Figure 1:
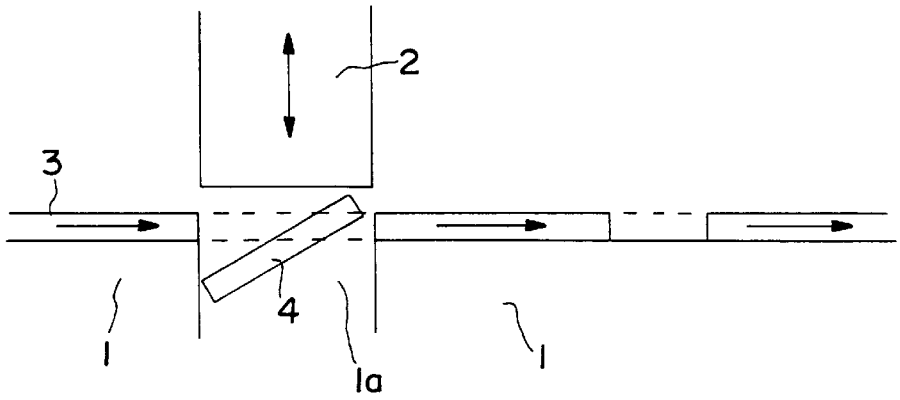
FIG. 1 is a internal side view of the interaction of the press and punch assembly, the die and the feed material.
Figure 2:
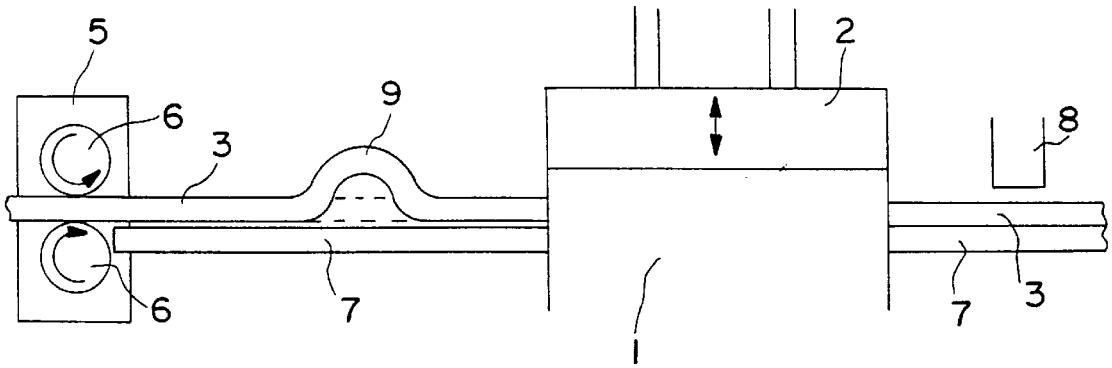
FIG. 2 is an external drawing of the arrangement of the press feed roll drive motor and the die with a buckle present in the feed material.
Figure 3:
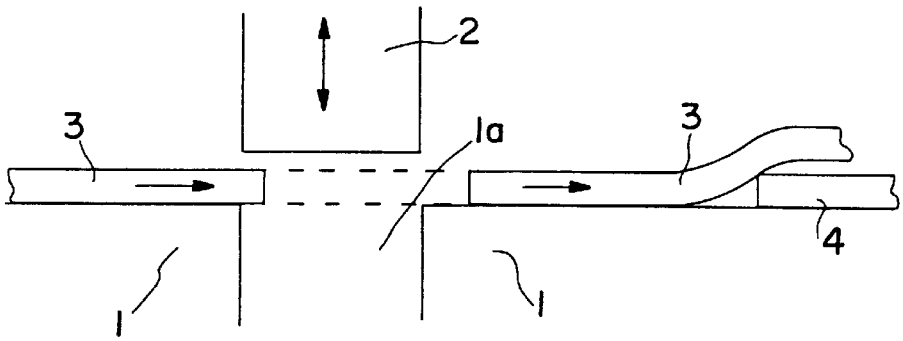
FIG. 3 is an internal side view of the press and punch assembly and the die showing a material jam condition.
Figure 4A:
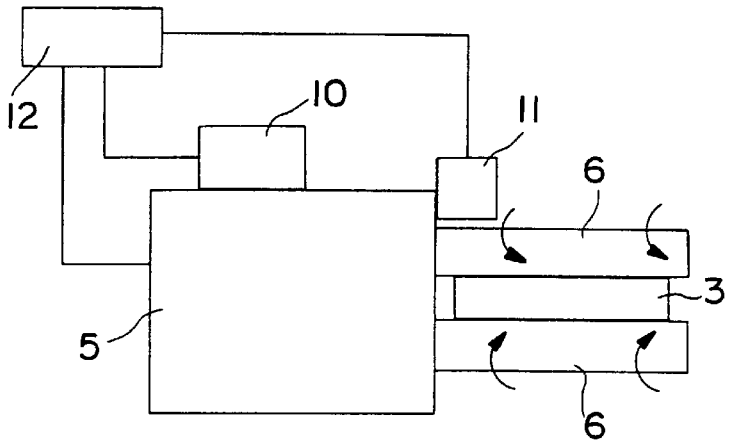
FIG. 4*a* is a front view of the press feed roll drive motor and the press feed rolls.
Figure 4B:
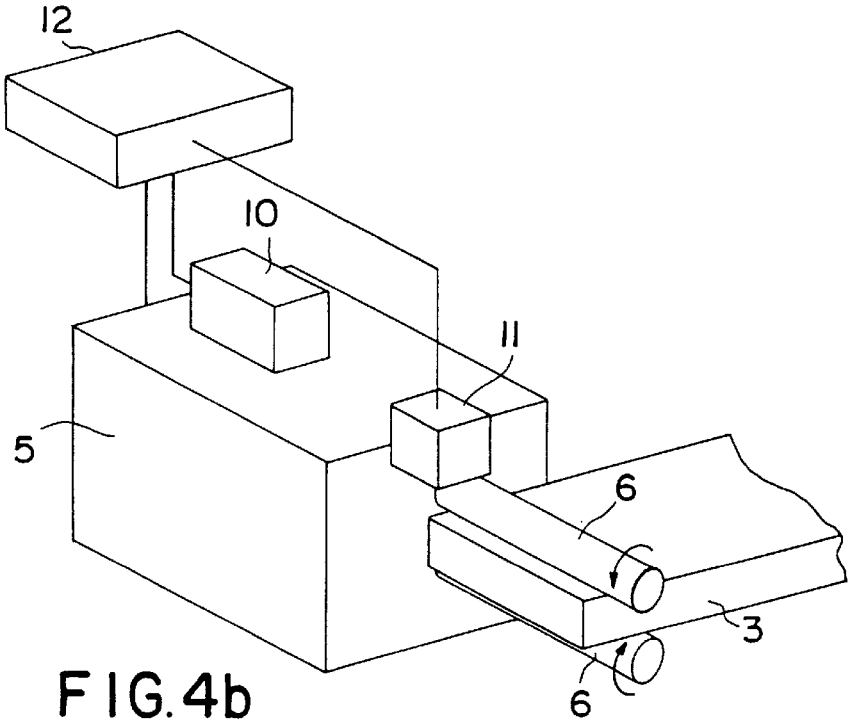
FIG. 4*b* is a side perspective view of the press feed roll drive motor and the press feed rolls acting on the feed material.
Figure 5:
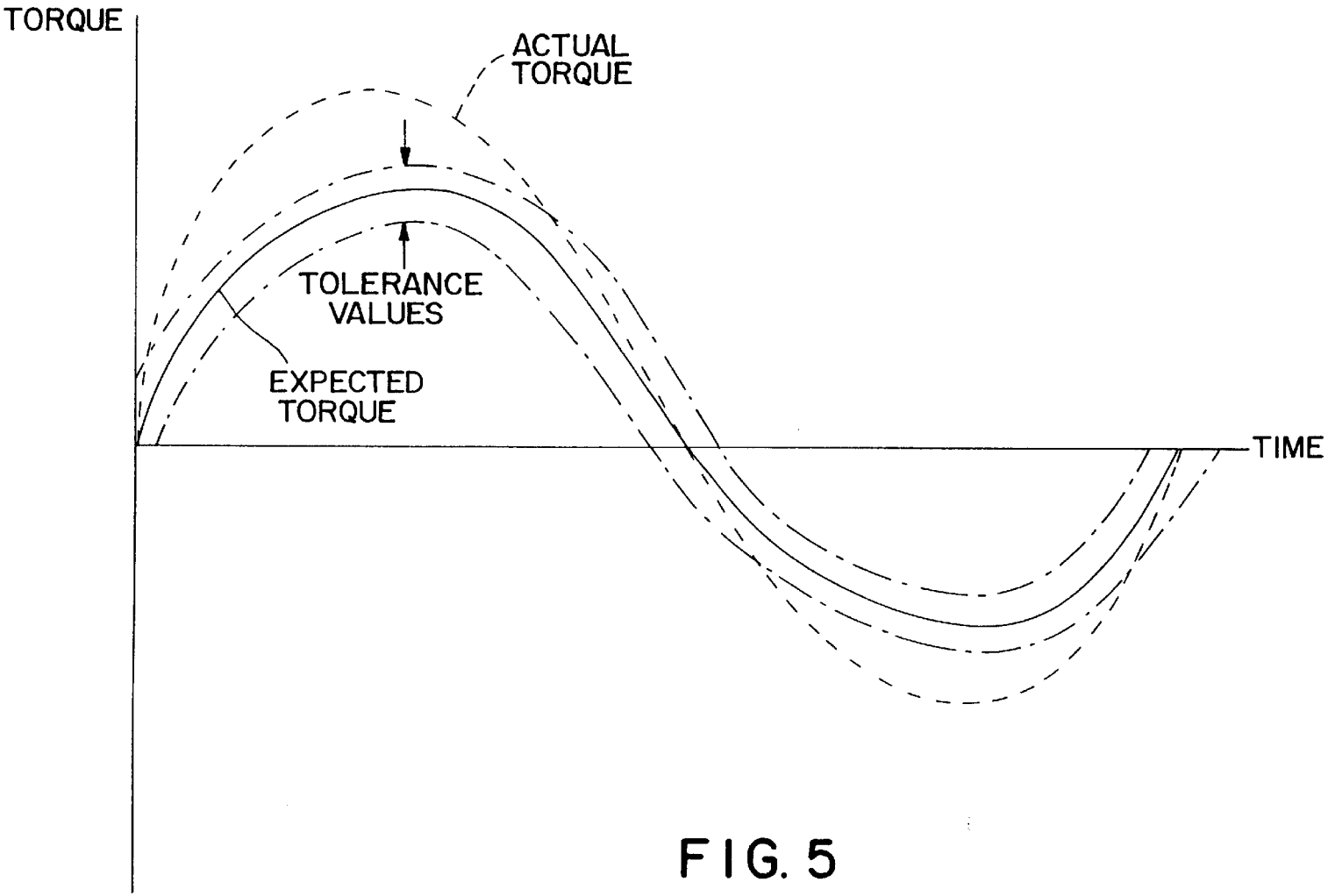
FIG. 5 a graphical depiction of the actual and expected torque of-the press feed roll drive motor.

To allow operation of the first preferred method, the apparatus, as depicted schematically in FIGS. 2, 4*a* and 4*b*, includes a resolver 11 to measure the angular position of at least one of the press feed rolls 6 which sends a signal to the motor controller 12 for the press feed roll drive motor 5. If the angular position of both press feed rolls 6 are measured, two signals are sent to the motor controller 12.

Figure 8:
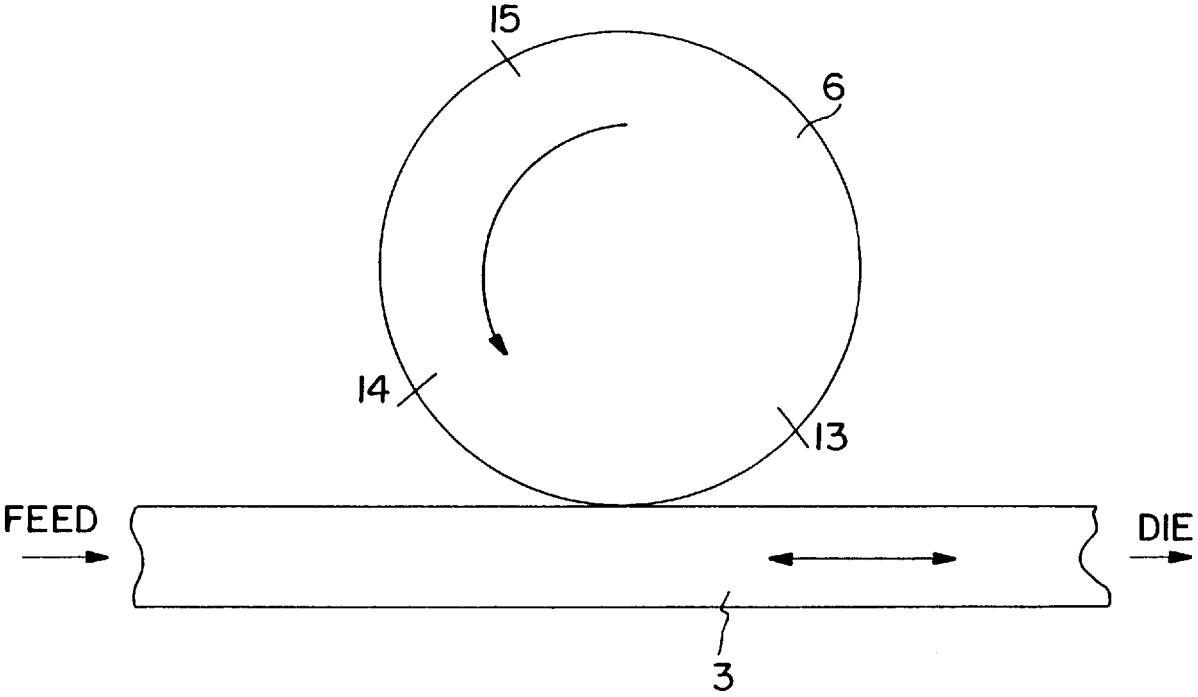
FIG. 8 is a close up schematic of a press feed roll and its position relative to the press feed material.

The motor controller 12 then compares the measured angular position of the roll or rolls 6 with the expected angular position of the roll or rolls and calculates the position error, simply the difference between the measured angular position and the expected angular position of the roll or rolls. As depicted schematically in FIG. 8, the roll 6 starts in a position where the roll contacts the feed material at the point on the roll labeled as 13. If no jam occurs, the roll 6 would move in the direction indicated to a position where the point on the roll labeled as 15 is in contact with the feed material. Due to the material jam, the roll 6 only advances to a position where the roll is in contact with the feed material at the point on the roll labeled as 14. The actual position error is the difference between angular position when the press feed roll is in contact with the feed material at the point on the roll labeled 15 and the angular position when the press feed roll is in contact with the feed material at the point on the roll labeled 14 on FIG. 8.

If the position error is outside a certain tolerance determined empirically for correctly stamped material indicating that a jam or misfeed has occurred, the motor controller 12 sends a signal to the press feed roll drive motor 5 to reverse direction of the press feed rolls 6 long enough to pull the feed material 3 back to the position it was in before the press feed roll motor advanced the feed material to the position it is in when the position error indicated a jam occurred. As depicted on FIG. 8, the press feed roll drive motor 5 must turn the press feed roll 6 from a position where the roll is in contact with the feed material at a point labeled as 14 back to a position where the roll is in contact with the feed material at a point labeled as 13. Simultaneously, the motor controller 12 sends a signal to stop operation of the material stamping equipment if desired.

The die operator may then physically check the die 1 for jams or misfeeds and clear any jams or misfeeds. Once any jams or misfeeds are corrected, the operator can resume the operation of the press feed roll drive motor 5 and the material stamping apparatus. If the material stamping equipment is not stopped, the feed material will be stamped in the corrected position it was pulled back to, usually the position in which it was last stamped.

A second preferred method of operation, depicted in FIG. 7, consists of monitoring the actual torque of the press feed roll drive motor and comparing it to the expected torque of the press feed roll drive motor. The expected torque of the press feed roll drive motor can be determined empirically by compiling data on operation of the material stamping equipment during times when no jams or misfeeds occur or the expected torque can be projected.

In the second preferred method of operation, the actual torque of the press feed roll drive motor can be monitored as a function of the angular position of the press crankshaft, the angular velocity of the press crankshaft, the angular position of the press feed rolls, the feed angle, and the feed length. The feed length is the total length of the feed material to be fed. The feed angle is the total arc of the press crankshaft in which the feed length will be progressed or fed. The actual angular positions of the press feed rolls are measured by a resolver 11 as disclosed in the first preferred embodiment. The angular position of the press crankshaft and the angular velocity of the press crankshaft can be measured by methods and devices known to persons skilled in the art. The feed angle and the feed length can be selected by the stamping machine operator using input methods and devices known to persons skilled in the art.

Alternatively, the method and apparatus, as depicted schematically in FIGS. 2, 4*a*, 4*b* and 7, are modified to include a device 10 such as a strain gauge to directly monitor the actual torque generated by the press feed roll drive motor 5 which sends a signal to the motor controller for the press feed roll drive motor 12.

The motor controller 12 then continuously compares the actual torque of the press feed roll drive motor 5 with the expected torque of the press feed roll drive motor 5. If the difference between the actual and expected torque is outside an empirically determined tolerance value, the motor controller 12 sends a signal to the press feed roll drive motor 5 to reverse direction of the press feed rolls 6 long enough to pull the feed material 3 back to the original position it was in before the press feed rolls advanced the feed material.

As shown and described above, the present invention provides a method and apparatus for protecting a die from damage due to material jams occurring in material stamping equipment such as presses or press feeds.

It is specifically contemplated that the present invention may be modified or configured as appropriate for the application. It is intended that the foregoing detailed description be regarded as illustrative rather than limiting, and it should be understood that the following claims, including any equivalents, are intended to define the scope of the invention.

What is claimed is:

1. A method of controlling the operation of a material feeding machine so as to protect a die in a downstream material stamping machine from damage due to material jams, said method comprising the steps of:

a) operating the material feeding machine to advance material therethrough in a forward direction by a certain distance and into the die of the material stamping machine for a next stamping operation on the material, b) monitoring a parameter of the material feeding machine while the material is moving therethrough, c) continuously comparing the monitored parameter with an expected value of the parameter while the material feeding machine is advancing the material therethrough, and d) operating the material feeding machine in a reverse direction and moving the material back to a position in which a last stamping operation on the material occurred, only if the monitored parameter deviates from the expected value of the parameter by a tolerance value and before the next stamping operation, such that the die in the material stamping machine can pass through a last stamped area on the material prior to operating the material feeding machine in a reverse direction.

2. The method of claim 1 wherein the monitored parameter is a torque of a component used in the material feeding machine for advancing the material therethrough.

3. The method of claim 1 wherein the monitored parameter is a position error of a component used in the material feeding machine for advancing the material therethrough.

4. The method of claim 1 wherein the monitored parameter is a torque of a motor used in the material feeding machine for advancing the material therethrough.

5. The method of claim 1 wherein the monitored parameter is a position error of a feed roll used in the material feeding machine for advancing the material therethrough.

6. The method of claim 1 wherein the monitored parameter is a velocity of a component used in the material feeding machine for advancing the material therethrough.

7. The method of claim 1 wherein the monitored parameter is an acceleration of a component used in the material feeding machine for advancing the material therethrough.

8. The method of claim 1 wherein the monitored parameter is a jerk of a component used in the material feeding machine for advancing the material therethrough.

9. The method of claim 1 wherein said tolerance value is empirically determined from operation of the material feeding machine without a jam occurring.

10. An apparatus for controlling the operation of a material feeding machine so as to protect a die in a downstream material stamping machine from damage due to material jams, said apparatus comprising:

a) means for operating the material feeding machine to advance material therethrough in a forward direction by a certain distance and into the die of the material stamping machine for a next stamping operation on the material, b) means for monitoring a parameter of the material feeding machine while the material is moving therethrough, c) means for continuously comparing the monitored parameter with an expected value of the parameter while the material feeding machine is advancing the material therethrough, and d) means for operating the material feeding machine in a reverse direction and moving the material back to a position in which a last stamping operation on the material occurred, only if the monitored parameter deviates from the expected value of the parameter by a tolerance value and before the next stamping operation, such that the die in the material stamping machine can pass through a last stamped area on the material prior to operating the material feeding machine in a reverse direction.

11. The apparatus of claim 10 wherein the monitored parameter is a torque of a component used in the material feeding machine for advancing the material therethrough.

12. The apparatus of claim 10 wherein the monitored parameter is a position error of a component used in the material feeding machine for advancing the material therethrough.

13. The apparatus of claim 10 wherein the monitored parameter is a torque of a motor used in the material feeding machine for advancing the material therethrough.

14. The apparatus of claim 10 wherein the monitored parameter is a position error of a feed roll used in the material feeding machine for advancing the material therethrough.

15. The apparatus of claim 10 wherein the monitored parameter is a velocity of a component used in the material feeding machine for advancing the material therethrough.

16. The apparatus of claim 10 wherein the monitored parameter is an acceleration of a component used in the material feeding machine for advancing the material therethrough.

17. The apparatus of claim 10 wherein the monitored parameter is a jerk of a component used in the material feeding machine for advancing the material therethrough.

18. The apparatus of claim 10 wherein said tolerance value is empirically determined from operation of the material feeding machine without a jam occurring.

* * * * *